United States Patent [19]

Gerling et al.

[11] Patent Number: 5,043,027

[45] Date of Patent: Aug. 27, 1991

[54] METHOD OF REESTABLISHING THE MALLEABILITY OF BRITTLE AMORPHOUS ALLOYS

[75] Inventors: Rainer Gerling, Reinbek; Frank-Peter Schimansky, Geesthacht, both of Fed. Rep. of Germany

[73] Assignee: GKSS-Forschungszentrum Geesthacht GmbH, Geesthacht, Fed. Rep. of Germany

[21] Appl. No.: 279,902

[22] Filed: Dec. 5, 1988

[30] Foreign Application Priority Data

Dec. 5, 1987 [DE] Fed. Rep. of Germany ..... 3741290

[51] Int. Cl.[5] ..... C21D 1/78

[52] U.S. Cl. ..... 148/13; 148/13.1; 148/14; 148/15; 148/20; 148/121; 148/403

[58] Field of Search ..... 148/13, 13.1, 14, 403, 148/15, 20, 121

[56] References Cited

U.S. PATENT DOCUMENTS

| | | | |
|---|---|---|---|
| 4,056,411 | 11/1977 | Chen et al. | 148/121 |
| 4,116,728 | 9/1978 | Becker et al. | 148/121 |
| 4,311,539 | 1/1982 | Uedaira et al. | 148/121 |
| 4,347,076 | 8/1982 | Ray et al. | 75/0.5 R |
| 4,365,994 | 12/1982 | Ray | 148/13.1 |

FOREIGN PATENT DOCUMENTS

| | | | |
|---|---|---|---|
| 213454 | 9/1984 | German Democratic Rep. | 148/403 |
| 1572284 | 7/1980 | United Kingdom | 148/403 |

OTHER PUBLICATIONS

Jones, H., "Observations on a Structural Transition in Aluminum Alloys Hardened by Rapid Solidification", Mater. Sci. Eng., 5 (1969), pp. 1-18.

*Primary Examiner*—R. Dean
*Assistant Examiner*—Margery S. Phipps
*Attorney, Agent, or Firm*—Robert W. Becker & Associates

[57] ABSTRACT

A method of reestablishing the deformability or malleability of embrittled amorphous alloys such as $Fe_{40}Ni_{40}P_{20}$ or $Fe_{20}Ni_{40}B_{20}$ or $Cu_{64}Ti_{36}$. An alloy is first subjected to a first temperature for a specific first time interval. Subsequently, the alloy is subjected in a sudden manner to a second temperature for a specific second time interval. The effecting of change of the temperature of the alloy from the first temperature to the second temperature occurs at a rate of 100° K./min. The first temperature is greater than the second temperature with the first temperature being in a temperature range between an embrittlement temperature and a crystallization temperature of the alloy.

8 Claims, 2 Drawing Sheets

METHOD OF REESTABLISHING THE MALLEABILITY OF BRITTLE AMORPHOUS ALLOYS

BACKGROUND OF THE INVENTION

The present invention relates to a method of reestablishing or restoring the deformability or malleability of an embrittled amorphous alloy.

It is known that amorphous alloys that are subjected to a high temperature become brittle; embrittlement of the amorphous alloys can even occur during the manufacturing process. In order for the amorphous alloys to be able to obtain certain magnetic properties, these alloys are treated at specific temperatures. However, the result of this thermal treatment is that the alloys become brittle with the disadvantageous result that magnetically optimum amorphous alloys can no longer be mechanically processed.

A further drawback of this type of manufacture of amorphous alloys is that, for example with flat bands or strips produced from these alloys, above a certain thickness these bands become so brittle that they are deformable or malleable only to a limited extent, although for certain applications it would be desirable for thicker bands to be assured of a good malleability.

Although it has previously been possible, in principle, to reestablish the malleability of embrittled amorphous alloys during manufacture or as a result of thermal treatment by subjecting these alloys to a particle beam composed of neutrons or lightweight ions, this known method has a considerable drawback since during the particle irradiation the amorphous alloys become radioactive, so that for all practical purposes a further processing is no longer possible. Thus, for nearly all applications of the amorphous alloys, this known method is unacceptable.

It is an object of the present invention to provide a method with which, in a very economical manner, brittle or embrittled amorphous alloys can again be made deformable or malleable without any fundamental change of the alloy characteristics and without any limitation of the applications for the alloys, whereby the inventive method is in principle applicable to all amorphous alloys.

SUMMARY OF THE INVENTION

This object, and other objects and advantages of the present invention, will appear more clearly from the following specification.

The method of the present invention is characterized by the steps of subjecting the alloy to a first temperature for a specific first time interval, and subsequently subjecting the alloy in a shock-like or sudden manner to a second temperature for a specific second time interval, whereby the first temperature is greater than the second temperature.

The advantage of the inventive method is that amorphous alloys that have been magnetically optimized, and hence became what was previously irreversibly brittle, can now, after the successful magnetic optimization, again be made malleable without affecting the magnetic properties. A further advantage is that after the inventive method has been carried out, the alloys without any negative impact can be mechanically handled, for example by stamping, drilling, grinding, bending, coiling, etc. With the method of the present invention, it is possible to reestablish the malleability of amorphous alloys that have become brittle during the manufacturing process. All of the aforementioned advantages are of great benefit.

Pursuant to one advantageous specific embodiment of the present invention, the first temperature can be variously selected as a function of the degree of embrittlement of the alloy, with this first temperature also being dependent upon the composition of the alloy.

The first temperature, again as a function of the degree of the embrittlement of the alloy, is advantageously in the range of from 200° to 600° C.

The first time interval, as a function of the degree of embrittlement of the alloy and/or as a function of the first temperature, is preferably set between $10^{-1}$ and $3\times10^{3}$ seconds, with the composition of the alloy and its prior treatment being parameters for determining the length of the first time interval.

An important feature for successfully carrying out the inventive method, i.e. for being able to achieve the desired malleability, is that the change of the temperature of the alloy from the first temperature to the second temperature be effected at a high rate, preferably at least 100° K./min. In this connection, the second temperature is also variously selectable as a function of the degree of embrittlement of the alloy.

Pursuant to a further advantageous specific embodiment of the present invention, the second temperature, as a function of the degree of embrittlement of the alloy, is between +150° and −200° C., with the second temperature being room temperature for many alloys.

In principle, the alloy can be brought to the first temperature in any conceivable manner, for example in an oil bath, via hot air, in hot inert gas, via radiant heat, etc. However, the alloy is preferably brought to the first temperature in a salt bath.

The alloy can also be brought to the second temperature in any desired manner. However, it is preferable for this purpose to use a water bath that is brought to the second temperature and into which the alloy is introduced.

BRIEF DESCRIPTION OF THE DRAWINGS

The present invention will now be described in detail with the aid of exemplary embodiments and the following graphs in which are plotted the results of measurements, and in which.

Prior to discussing in detail the actual method for reestablishing or restoring the deformability or malleability of amorphous alloys that have become brittle, the relative breaking tension elongation at break or relative strain at fracture (fracture strain) $\epsilon_f$ as a function of the annealing temperature will be explained with the aid of the graph illustrated in FIG. 1. This graph shows the relative breaking tension elongation at break $\epsilon_f$ of an amorphous $Fe_{40}Ni_{40}P_{20}$ alloy at different annealing temperatures. The amorphous alloy is in the form of a metal band or strip that has a thickness of 20 $\mu$m. Samples of this metal alloy with annealing having taken place at different temperatures, were subjected to a bending test to determine the relative breaking tension elongation at break $\epsilon_f$ of the samples. As indicated previously, the break tension $\epsilon_f$ is an indication of the malleability or embrittlement of the alloy. If the $\epsilon_f=1$, the alloy band can be bent by 180° without breaking. If $\epsilon_f<1$, the alloy band breaks when it is bent; the smaller $\epsilon_f$ is, the sooner the band will break.

Figure 1:
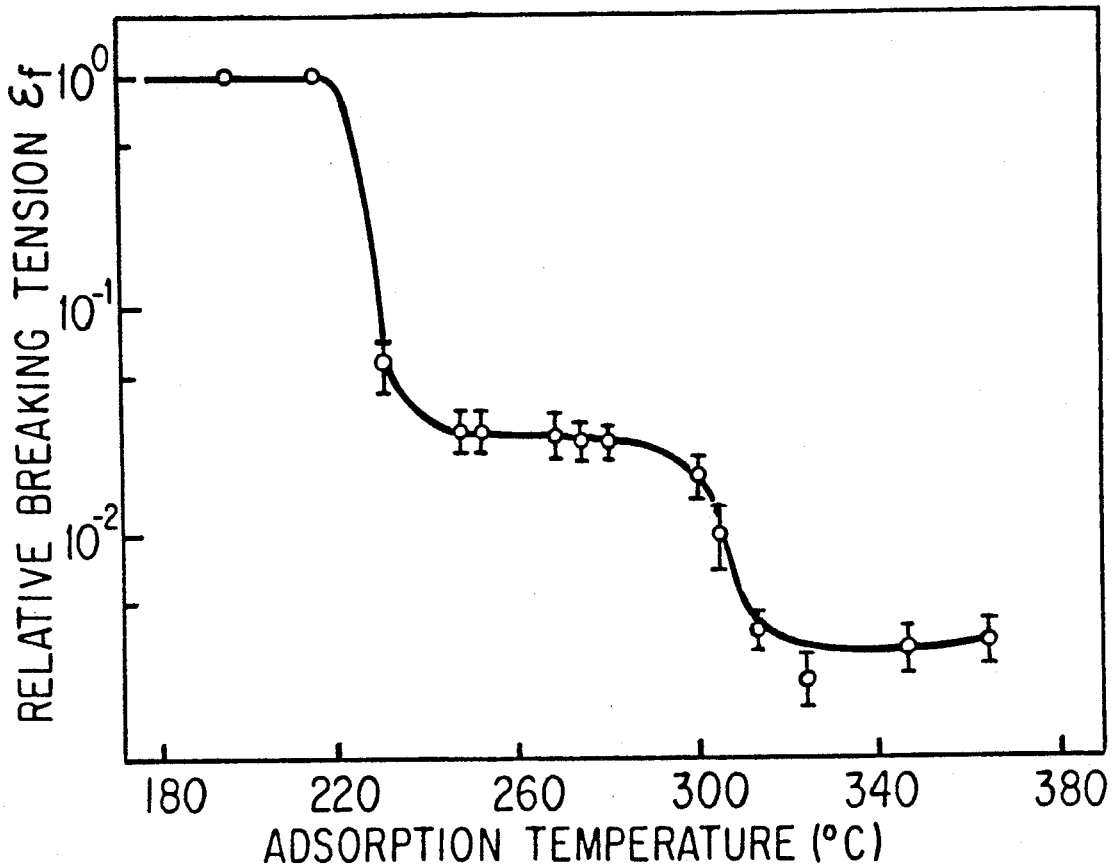
FIG. 1 is a view that illustrates the relative breaking tension elongation at break or relative strain at fracture (fracture strain) of a band-like amorphous Fe Ni P alloy after isochronous adsorption (43 hours) plotted against different temperatures.

FIG. 1 shows that the alloy band is very deformable or malleable up to a temperature of approximately 210° C.; i.e. $\epsilon_f=1$. As the temperature increases, the malleability decreases, with the brittleness of the alloy increasing at the same time, i.e. $\epsilon_f<1$. A plateau is reached in the temperature range of 230° to 300° C.; in other words, in this temperature range the malleability has a nearly constant $\epsilon_f<1$ value. However, in this temperature range the alloy is already very brittle. A further embrittlement sets in at a temperature of greater than 300° C. This second stage of the embrittlement ends in the crystallization of the alloy.

Pursuant to the method of the present invention, in order to reestablish or restore the deformability or malleability of the embrittled amorphous alloy, this alloy is subjected to a temperature $T_1$ (the recovery temperature) for a certain time interval $\Delta t_1$. The alloy is subsequently subjected in a shock-like or sudden manner to a temperature $T_2$ (the quenching temperature) for a certain time interval $\Delta t_2$. The temperature $T_1$ is in the temperature range between an embrittlement temperature $T_3$ and the temperature of crystallization that is applicable under these conditions.

Figure 2:
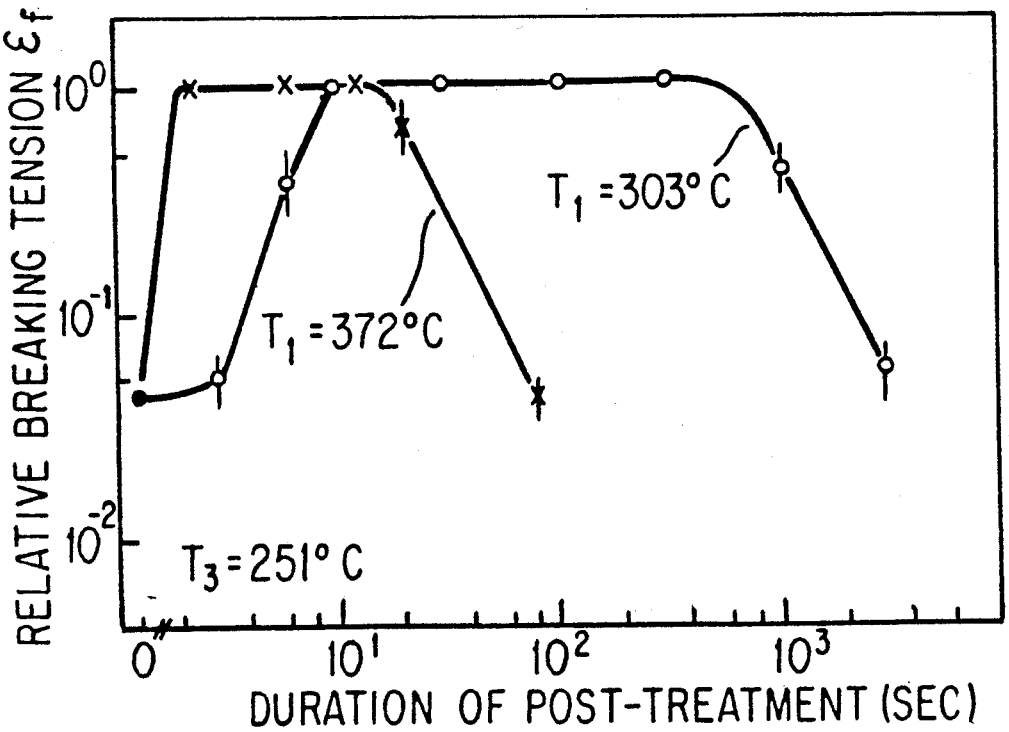
FIG. 2 is a view that illustrates the relative breaking tension elongation at break or relative strain at fracture (fracture strain) plotted against the duration of a post-treatment at two different post-treatment temperatures.

FIG. 2 shows the reestablishment of the malleability of an $Fe_{40}Ni_{40}P_{20}$ sample that was previously embrittled at $T_3=251°$ C. The malleability of the sample is illustrated in FIG. 2 at two recovery temperatures $T_1$, namely 303° and 372° C. At $T_1=303°$ C., the time interval $\Delta t_3$ for reestablishing a relative breaking tension elongation at break $\epsilon_f=1$ is between 10 and $3\times10^2$ seconds. At $T_1=372°$ C., the time interval $\Delta t_1$ for the post-treatment is between 1 and 12 seconds. In principle, the malleability can be reestablished at all temperatures between 303° and 372° C. In the present example, the quenching temperature $T_2$ corresponds to room temperature.

Figure 3:
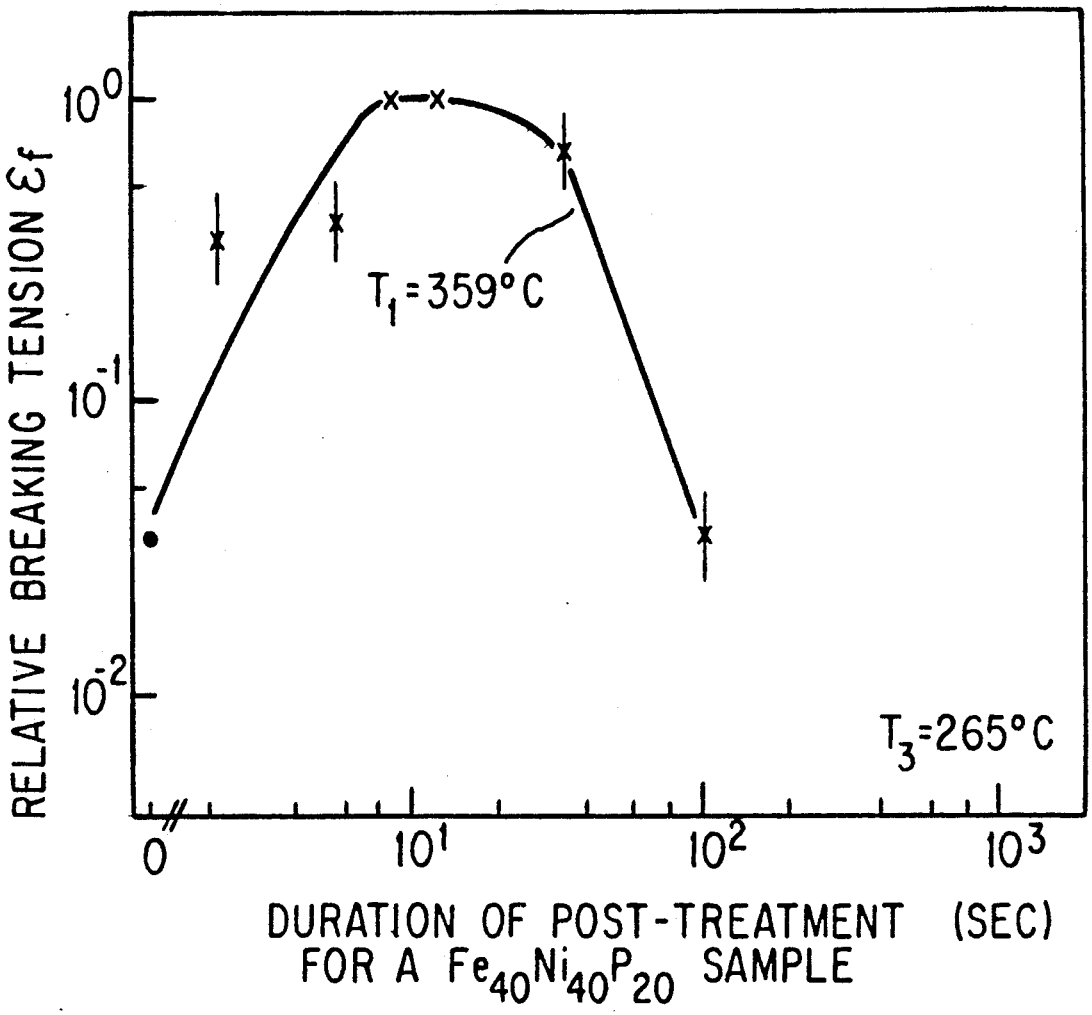
FIG. 3 is a view that illustrates the relative breaking tension elongation at break or relative strain at fracture (fracture strain) plotted against the duration of post-treatment of a further alloy sample.

FIG. 3 shows the reestablishment of the malleability of the band-like amorphous alloy of FIG. 2 where this alloy was embrittled at a temperature $T_3=265°$ C. The reestablishment of the malleability in this case was achieved at a temperature of $T_1=359°$ C. The time interval $\Delta t_1$ in which a relative breaking tension elongation at break of $\epsilon_f=1$ can be achieved is between 7 and 15 seconds.

It should be noted that the amorphous alloy $Fe_{40}Ni_{40}P_{20}$ that was mentioned above by way of example only is a typical alloy of the class of amorphous alloys that, in addition to transition metal elements (e.g. Fe, Ni), contain a vitrifier or glass former (e.g. P). As tests have shown, the method of the present invention can in principle be used for all amorphous alloys. Thus, such amorphous alloys as $Fe_{40}Ni_{40}B_{20}$ and $Cu_{64}Ti_{36}$ can be successfully treated pursuant to the inventive method with equally good results, so that the desired malleability is achieved at the conclusion of the method.

The inventive method has the advantage that it is now possible to magnetically optimize large quantities of an amorphous alloy and to then eliminate the accompanying embrittlement with the use of the inventive method, whereby it is then possible to produce from the amorphous alloys widely differing components without restrictions. Although it would have been possible in principle, in some cases it was not previously possible to optimize the mechanical properties of amorphous alloys because the accompanying embrittlement of the alloy would have been too great and would not have permitted a further processing. However, pursuant to the method of the present invention, components with improved characteristics can now be produced. In addition, it is now possible to produce thicker amorphous bands that, although they are brittle after the manufacturing process, can nonetheless be made malleable pursuant to the method of the present invention.

By way of example, during the production of spools or coils, up to now the starting material was initially wound onto a spool body, and thereafter the finished spool was thermally treated in order to optimize magnetic properties. However, this means that the material of the spool body must be able to withstand this temperature treatment without undergoing any changes. The inventive method makes it possible to first magnetically optimize the starting material, then make the material malleable using the method of the present invention, and subsequently wind the material on a spool body.

A further advantage of the inventive method is that now the optimized amorphous alloys can be combined with materials that cannot withstand high temperatures.

Up to now, producers of amorphous alloys have produced very few finished components. A greater portion of the alloys is sold to others who further process the alloys. These other companies then manufacture components and carry out optimization of the magnetic properties. Pursuant to the present invention it is now possible for the producer of amorphous alloys to offer already optimized alloys.

The present invention is, of course, in no way restricted to the specific disclosure of the specification and drawings, but also encompasses any modifications within the scope of the appended claims.

What we claim is:

1. A method of reestablishing the deformability or malleability of an embrittled amorphous alloy containing at least one transition metal element and optionally a vitrifying or glass forming element, said method comprising essentially of the steps of:

subjecting said alloy to a first temperature for a specific first time interval, said first temperature being in a range between 200° C. and 600° C. and said first time interval being in a range between $10^{-1}$s and $3\times10^3$s; cooling off from said first temperature to a second temperature in a rapid manner with a rate of at least 100° K./min, maintaining said alloy at said second temperature, wherein said second temperature lies in a range between 150° C. and −200° C.

2. A method according to claim 1, wherein said embrittled amorphous alloy is selected from the group consisting of $Fe_{40}Ni_{40}P_{20}$; $Fe_{40}Ni_{40}B_{20}$; and $Cu_{64}Ti_{36}$.

3. A method according to claim 1, which includes the step of establishing said first temperature as a function of the degree of embrittlement of said alloy.

4. A method according to claim 1, which includes the step of establishing the length of said first time interval, as a function of at least one of the group consisting of the degree of embrittlement of said alloy and said first temperature, the range of from $10^{-1}$ to $3\times10^{3}$ seconds.

5. A method according to claim 1, which includes the step of establishing said second temperature as a function of the degree of embrittlement of said alloy.

6. A method according to claim 1, in which said second temperature is room temperature.

7. A method according to claim 1, in which said first subjecting step is effected by bringing said alloy to said first temperature in a salt bath.

8. A method according to claim 1, in which said maintaining step is effected by introducing said alloy into a water bath to bring said alloy in a rapid manner to said second temperature.

* * * * *